US007058503B2

(12) United States Patent
Toyoshima et al.

(10) Patent No.: US 7,058,503 B2
(45) Date of Patent: Jun. 6, 2006

(54) FUEL SUPPLY CONTROL SYSTEM FOR INTERNAL COMBUSTION ENGINE

(75) Inventors: Hirokazu Toyoshima, Wako (JP); Tatsuhito Esaki, Wako (JP); Nobuyuki Kawaguchi, Wako (JP)

(73) Assignee: Honda Motor Co. Ltd., Tokyo (JP)

( * ) Notice: Subject to any disclaimer, the term of this patent is extended or adjusted under 35 U.S.C. 154(b) by 0 days.

(21) Appl. No.: 11/090,487

(22) Filed: Mar. 28, 2005

(65) Prior Publication Data

US 2005/0216173 A1 Sep. 29, 2005

(30) Foreign Application Priority Data

Mar. 29, 2004 (JP) ..... 2004-094114

(51) Int. Cl.
*F02D 41/04* (2006.01)
*F02D 13/06* (2006.01)

(52) U.S. Cl. ..... 701/104

(58) Field of Classification Search ..... 701/104, 701/103, 102, 115; 123/480, 481, 486, 198 F
See application file for complete search history.

(56) References Cited

U.S. PATENT DOCUMENTS 4,434,760 A * 3/1984 Kobayashi et al. ..... 477/111
5,261,370 A * 11/1993 Ogawa et al. ..... 123/480
5,867,983 A * 2/1999 Otani ..... 123/406.23

FOREIGN PATENT DOCUMENTS

JP 60-13932 A 1/1985

* cited by examiner

*Primary Examiner*—Hieu T. Vo
(74) *Attorney, Agent, or Firm*—Arent Fox PLLC

(57) ABSTRACT

A fuel supply control system for an internal combustion engine wherein an operating condition of the engine is detected and an amount of fuel supplied to the engine is controlled according to the detected operating condition of the engine. A cooling degree of at least one exhaust valve of the engine is estimated, and the fuel amount is corrected in an increasing direction based on the estimated cooling degree of the at least one exhaust valve. The corrected fuel amount is then supplied to the engine.

18 Claims, 11 Drawing Sheets

FUEL SUPPLY CONTROL SYSTEM FOR INTERNAL COMBUSTION ENGINE

BACKGROUND OF THE INVENTION

1. Field of the Invention

The present invention relates to a fuel supply control system for an internal combustion engine, and particularly, to a control system that corrects an amount of supplied fuel according to an operating condition of the internal combustion engine.

2. Description of the Related Art

An example of a fuel supply control system for an internal combustion engine is disclosed in Japanese Patent Laid Open Sho 60-13932. The known fuel supply control system controls a fuel supply to an internal combustion engine whose operation can be switched between a partial-cylinder operation, wherein operation of some of the cylinders is halted, and an all-cylinder operation, wherein all of the cylinders are operated. According to the known fuel supply control system, when engine operation shifts from the partial-cylinder operation to the all-cylinder operation, fuel is supplied to the cylinders that are halted during the partial-cylinder operation by an amount greater than the amount of fuel supplied to the cylinders that are operated during the partial-cylinder operation for a predetermined period of time.

According to the conventional fuel supply control system, it is possible to prevent the operating performance (combustion state) of the engine from deteriorating due to a reduction in temperature of the cylinders that are not operating during the partial cylinder operation when the all-cylinder operation is restarted.

Exhaust valves of operating cylinders in an internal combustion engine are exposed to hot exhaust gases, while the exhaust valves of halted or non-operating cylinders are not exposed to such hot exhaust gases. Accordingly, it is confirmed that a lift amount of the exhaust valve slightly changes depending on whether the cylinder is operating or halted due to the thermal expansion or contraction of the valve body of the exhaust valve. Further, when the exhaust valve is opened, a part of the hot exhaust gases may return to the combustion chamber. If the lift amount of the exhaust valve changes, the amount of returning exhaust gases changes.

In the conventional fuel supply control system described above, the change in the lift amount of the exhaust valve is not taken into consideration. Accordingly, the incremental amount of fuel supplied to the halted cylinders during the partial-cylinder operation may be incorrect, which makes an air-fuel ratio of the air-fuel mixture in the combustion chamber deviate from a desired value and the exhaust characteristic of the engine is ultimately degraded.

In a further example, wherein the fuel supply to the operating cylinders is interrupted during the partial-cylinder operation, the lift amount of each exhaust valve slightly changes immediately after the supply of fuel is restarted. Therefore, the air-fuel ratio deviation may occur in the operating cylinders during the partial-cylinder operation.

SUMMARY OF THE INVENTION

The present invention is made contemplating the above-described points. It is an aspect of the present invention to provide a fuel supply control system which suppresses a deviation of the air-fuel ratio from a desired value by controlling a fuel supply amount in consideration of a temperature of the exhaust valve that changes depending on the operating condition of the internal combustion engine.

In view of the above, the present invention provides a fuel supply control system for an internal combustion engine having an operating condition detector which detects an operating condition of the engine and a fuel supply amount controller which controls an amount (TCYL, TCYLB2) of fuel supplied to the engine according to the operating condition of the engine. The control system also includes an exhaust valve cooling estimator which estimates a cooling degree (TEXVLV, TEXVLVB2) of at least one exhaust valve of the engine and a fuel amount corrector which corrects the fuel amount (TCYL, TCYLB2) in an increasing direction based on the cooling degree (TEXVLV, TEXVLVB2) estimated by the exhaust-valve cooling estimator. The fuel supply amount controller supplies the fuel amount, corrected by the fuel amount corrector, to the engine.

Given the above-described structural configuration of the present invention, the cooling degree of the exhaust valve of the engine is estimated, the fuel amount to be supplied to the engine is corrected in an increasing direction based on the estimated cooling degree, and the corrected fuel amount is supplied to the engine. Therefore, even when the cooling degree of the exhaust valve changes, due to the engine operating condition, and the lift amount of the exhaust valve changes, the fuel supply amount is appropriately corrected in the increasing direction to suppress any undesirable deviation in the air-fuel ratio.

Preferably, the operating condition detector includes a rotational-speed detector, which detects a rotational speed (NE) of the engine, and an intake pressure detector, which detects an intake pressure (PBA) of the engine, wherein the exhaust valve cooling estimator estimates the cooling degree (TEXVLV, TEXVLVB2) according to at least one of the detected engine rotational speed (NE) and the detected intake pressure (PBA).

Given the above-described structural configuration of the present invention, the cooling degree of an exhaust valve is estimated according to at least one of the detected engine rotational speed and the detected intake pressure. That is, the estimation of the cooling degree is performed using the parameter(s) depending on the exhaust flow rate, which has significant influence on the cooling degree of the exhaust valve. Accordingly, an accurate estimation of the cooling degree is performed.

Preferably, the operating condition detector includes an intake air flow rate detector which detects an intake air flow rate (Gair) of the engine. The exhaust valve cooling estimator estimates the cooling degree (TEXVLV, TEXVLVB2) according to the detected intake air flow rate (Gair).

Given the above-described structural configuration of the present invention, the cooling degree of the exhaust valve is estimated according to the detected intake air flow rate. That is, the estimation of the cooling degree is performed using a parameter indicative of the exhaust flow rate which has a relatively large or significant influence on the cooling degree of the exhaust valve. Accordingly, accurate estimation of the cooling degree is performed.

Preferably, the fuel amount corrector includes a complete cooling correction amount calculator, which calculates a complete cooling correction amount (KTVLV, KTVLVB2) according to the engine operating condition (NE, PBA), and a cooling degree correction coefficient calculator, which calculates a cooling degree correction coefficient (KVLVAF, KVLVAFB2) according to the cooling degree (TEXVLV, TEXVLVB2). The complete cooling correction amount (KTVLV, KTVLVB2) is a correction amount corresponding to a complete cooling state of at least one exhaust valve. The fuel amount corrector corrects the fuel amount (TCYL, TCYLB2) using the complete cooling correction amount (KTVLV, KTVLVB2) and the cooling degree correction coefficient (KVLVAF, KVLVAFB2).

The complete cooling state is defined herein as a state wherein the temperature of the exhaust valve becomes equal to or less than 300 degrees Centigrade, and the lift amount of the exhaust valve minimally changes, even if the temperature decreases further.

Given the above-described structural configuration of the present invention, the complete cooling correction amount, which is a correction amount corresponding to the complete cooling state of the exhaust valve, and the cooling degree correction coefficient, according to the cooling degree, are calculated, and the fuel supply amount is corrected using the complete cooling correction amount and the cooling degree correction coefficient. The relationship between the cooling degree of the exhaust valve and the air-fuel ratio deviation is nonlinear. Therefore, by properly setting the cooling degree correction coefficient according to the engine operating condition, and setting the cooling degree correction coefficient based on the actual relationship between the cooling degree of the exhaust valve and the air-fuel ratio deviation, accurate correction is performed.

Preferably, the engine has a plurality of cylinders and switches which switch between a partial-cylinder operation wherein operation of at least one cylinder is halted or not operating, and an all-cylinder operation wherein all of the cylinders are operating. The fuel supply amount controller has a fuel supply interrupter which interrupts a supply of fuel to at least one operating cylinder according to the engine operating condition. The exhaust valve cooling estimator estimates the cooling degree (TEXVLV, TEXVLVB2) according to whether the all-cylinder operation or the partial-cylinder operation is being performed and whether the fuel supply interruption is being performed.

Given the above-described structural configuration of the present invention, the cooling degree is estimated according to whether the all-cylinder operation or the partial-cylinder operation is being performed and whether the fuel supply interruption is being performed. In the cylinder, which is not operating during the partial-cylinder operation, or in the cylinder to which the fuel supply is interrupted, the cooling degree of the exhaust valve increases or becomes relatively large. Therefore, accurate estimation of the cooling degree is performed by taking these factors into consideration.

There is a tendency for the air-fuel ratio to shift in a lean direction as the cooling degree (TEXVLV, TEXVLVB2) of the exhaust valve increases. Therefore, it is preferable that the fuel amount corrector corrects the fuel amount so that the fuel amount increases as the cooling degree (TEXVLV, TEXVLVB2) increases.

DETAILED DESCRIPTION OF THE PREFERRED EMBODIMENTS

Preferred embodiments of the present invention will now be described with reference to the drawings.

First Embodiment

Figure 1:
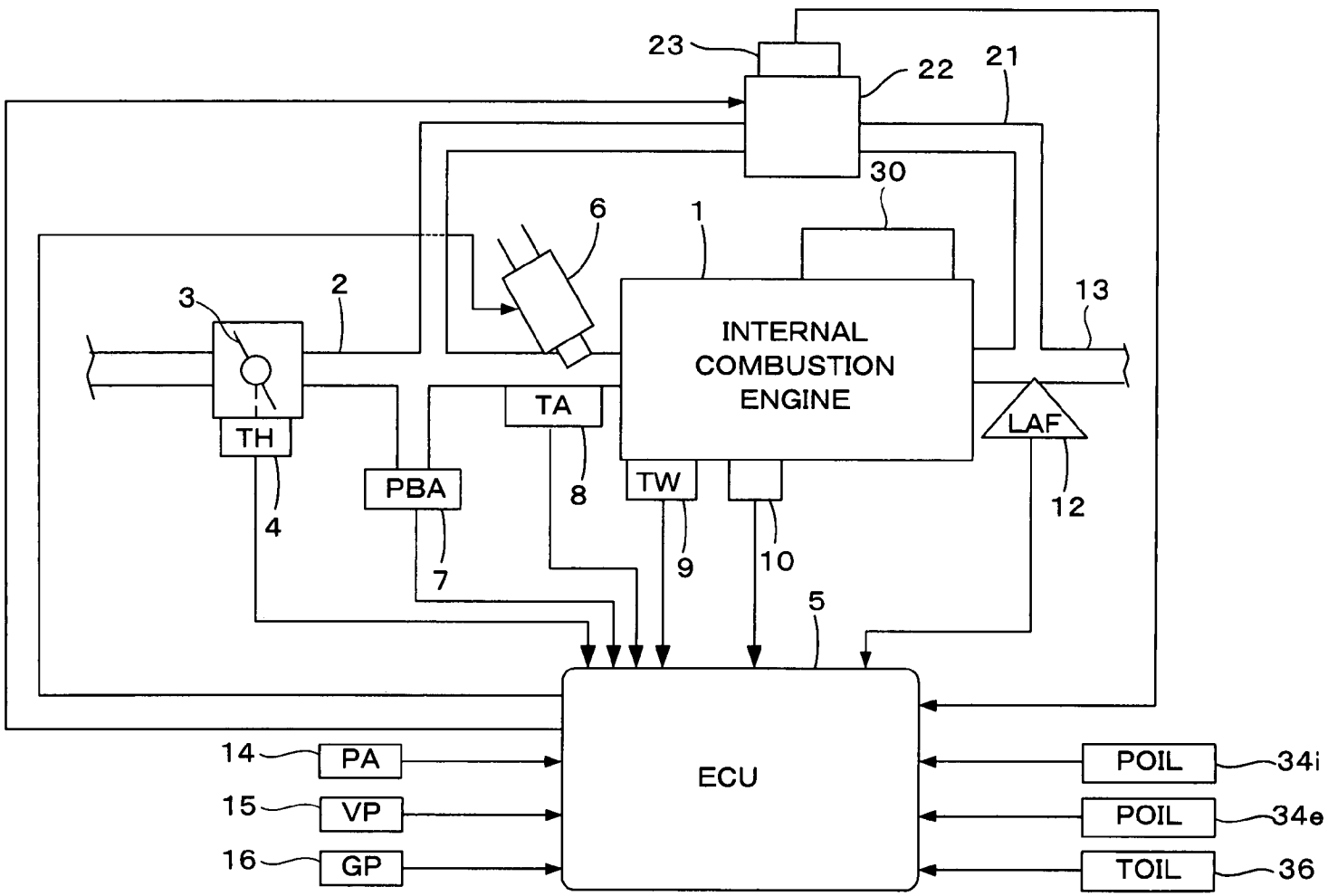
FIG. 1 is a schematic diagram illustrating the structural configuration of an internal combustion engine and a fuel supply control system therefor according to an embodiment of the present invention.
Figure 2:
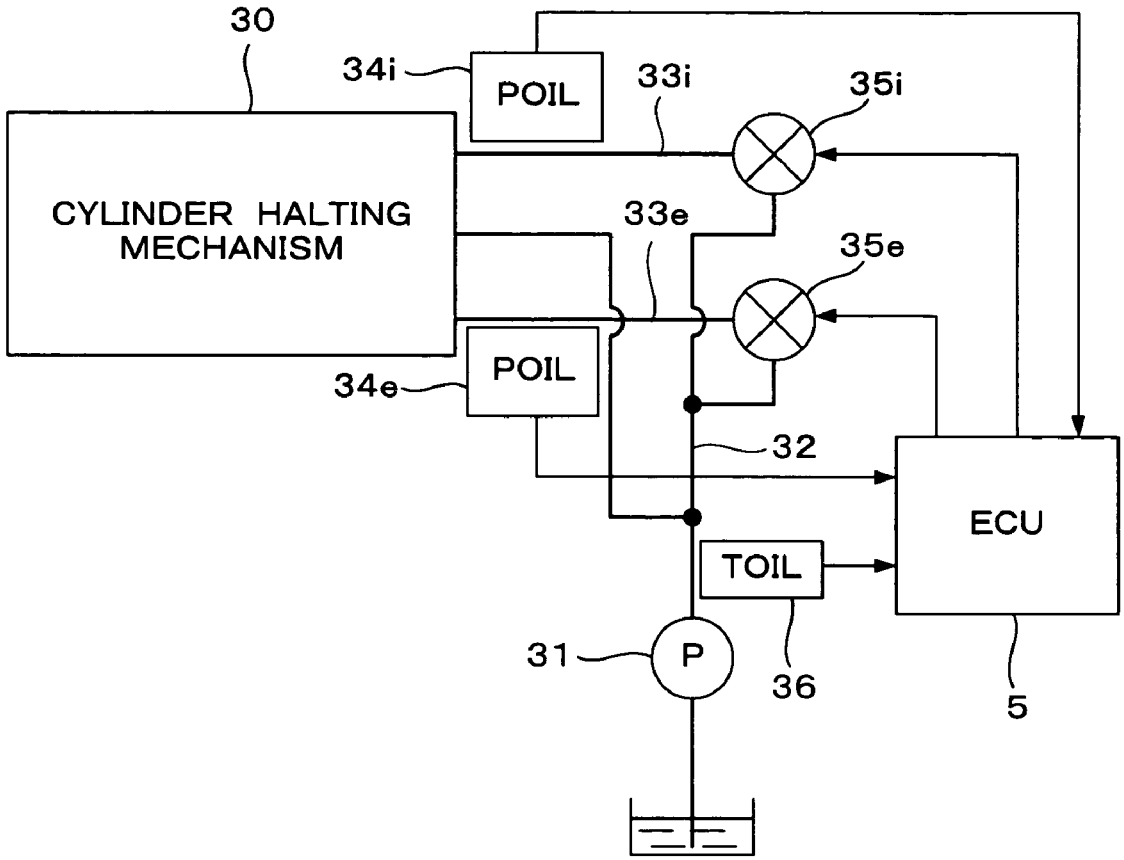
FIG. 2 is a schematic diagram illustrating the structural configuration of a hydraulic control system of a cylinder halting mechanism according to an embodiment of the present invention.

FIG. 1 is a schematic diagram of an internal combustion engine and a corresponding control system according to a first embodiment of the present invention. The internal combustion engine 1, which may be, for example, a V-type six-cylinder internal combustion engine, but is hereinafter referred to simply as engine, has a right bank including cylinders #1, #2 and #3 and a left bank including cylinders #4, #5 and #6. The right bank further includes a cylinder halting mechanism 30, which temporarily halts operation of cylinders #1 to #3. FIG. 2 is a schematic diagram of a hydraulic circuit for hydraulically driving the cylinder halting mechanism 30, and a control system for the hydraulic circuit. FIG. 2 will be referred to in conjunction with FIG. 1.

The engine 1 has an intake pipe 2 including a throttle valve 3. The throttle valve 3 is provided with a throttle valve opening sensor 4 which detects an opening TH of the throttle valve 3. A detection signal output from the throttle opening sensor 4 is supplied to an electronic control unit (hereinafter referred to as "ECU 5").

Fuel injection valves 6, for respective cylinders, are inserted into the intake pipe 2 at locations intermediate the engine 1 and the throttle valve 3 and slightly upstream of respective intake valves (not shown). Each fuel injection valve 6 is connected to a fuel pump (not shown) and electrically connected to the ECU 5. A valve opening period of each fuel injection valve 6 is controlled by a signal from the ECU 5.

An absolute intake pressure (PBA) sensor 7 is provided immediately downstream of the throttle valve 3 and detects a pressure in the intake pipe 2. An absolute pressure signal, converted to an electrical signal by the absolute intake pressure sensor 7, is supplied to the ECU 5. An intake air temperature (TA) sensor 8 is provided downstream of the absolute intake pressure sensor 7 and detects an intake air temperature TA. An electrical signal, corresponding to the detected intake air temperature TA, is output from the sensor 8 and supplied to the ECU 5.

An engine coolant temperature (TW) sensor 9, such as, for example, a thermistor, is mounted on the body of the engine 1 and detects an engine coolant temperature, i.e., a cooling water temperature, TW. A temperature signal corresponding to the detected engine coolant temperature TW is output from the sensor 9 and supplied to the ECU 5.

A crank angle position sensor 10 detects a rotational angle of the crankshaft (not shown) of the engine 1 and is connected to the ECU 5. A signal, corresponding to the detected rotational angle of the crankshaft, is supplied to the ECU 5. The crank angle position sensor 10 includes a cylinder discrimination sensor which outputs a pulse (hereinafter referred to as CYL pulse) at a predetermined crank angle position for a specific cylinder of the engine 1. The crank angle position sensor 10 also includes a top dead center (TDC) sensor which outputs a TDC pulse at a crank angle position before a TDC of a predetermined crank angle starts at an intake stroke in each cylinder (i.e., at every 120° crank angle in the case of a six-cylinder engine) and a crank angle (CRK) sensor for generating one pulse (hereinafter referred to as CRK pulse) with a CRK period (e.g., a period of 30°, shorter than the period of generation of the TDC pulse). The CYL pulse, the TDC pulse and the CRK pulse are supplied to the ECU 5. The CYL, TDC and CRK pulses are used to control the various timings, such as a fuel injection timing and an ignition timing, and to detect an engine rotational speed NE.

An exhaust valve 13 is provided with an oxygen concentration sensor 12 (hereinafter referred to as LAF sensor) for detecting an oxygen concentration in exhaust gases. The oxygen concentration sensor 12 outputs a detection signal which is proportional to the oxygen concentration (air-fuel ratio) in exhaust gases. The detection signal is supplied to the ECU 5.

The cylinder halting mechanism 30 is hydraulically driven using lubricating oil of the engine 1 as an operating oil. The operating oil, which is pressurized by an oil pump 31, is supplied to the cylinder halting mechanism 30 via an oil passage 32, an intake side oil passage 33*i*, and an exhaust side oil passage 33*e*. An intake side solenoid valve 35*i* is provided between the oil passage 32 and the intake side oil passage 33*i*. An exhaust side solenoid valve 35*e* is provided between the oil passage 32 and the exhaust side oil passage 33*e*. The intake and exhaust side solenoid valves 35*i* and 35*e*, respectively, are connected to the ECU 5 so that operation of the solenoid valves 35*i* and 35*e* is controlled by the ECU 5.

Hydraulic switches 34*i* and 34*e*, which are turned on when the operating oil pressure drops to a pressure lower than a predetermined threshold value, are provided, respectively, for the intake and exhaust side oil passages 33*i* and 33*e*. Detection signals of the hydraulic switches 34*i* and 34*e* are supplied to the ECU 5. An operating oil temperature sensor 36, which detects an operating oil temperature TOIL, is provided in the oil passage 32, and a detection signal of the operating oil temperature sensor 36 is supplied to the ECU 5.

An exemplary configuration of a cylinder halting mechanism is disclosed in Japanese Patent Laid-open No. Hei 10-103097, and a similar cylinder halting mechanism is used as the cylinder halting mechanism 30 of the present invention. The contents of Japanese Patent Laid-open No. Hei 10-103097 are hereby incorporated by reference. According to the cylinder halting mechanism 30, when the solenoid valves 35*i* and 35*e* are closed and the operating oil pressures in the oil passages 33*i* and 33*e* are low, the intake valves and the exhaust valves of the cylinders (i.e., #1 to #3) perform normal opening and closing movements. On the other hand, when the solenoid valves 35*i* and 35*e* are open and the operating oil pressures in the oil passages 33*i* and 33*e* are high, the intake valves and the exhaust valves of the cylinders (i.e., #1 to #3) maintain their closed state. In other words, while the solenoid valves 35*i* and 35*e* are closed, an all-cylinder operation of the engine 1, wherein all cylinders are operating, is performed. If the solenoid valves 35*i* and 35*e* are opened, a partial-cylinder operation, wherein the cylinders #1 to #3 are not operating or halted and only the cylinders #4 to #6 are operating, is performed.

An exhaust gas recirculation passage 21 extends between a portion of the intake pipe 2 downstream of the throttle valve 3 and an exhaust pipe 13. The exhaust gas recirculation passage 21 has an exhaust gas recirculation valve, hereinafter referred to as EGR valve 22, to control the amount of recirculated exhaust gases. The EGR valve 22 includes a solenoid-operated valve, the opening of the valve being controlled by the ECU 5. The EGR valve 22 is combined with a lift sensor 23 to detect an opening of the EGR valve 22 (i.e., valve lift amount, LACT) and supplies a detection signal to the ECU 5. The exhaust gas recirculation passage 21 and the EGR valve 22 jointly form an exhaust gas recirculation mechanism.

An atmospheric pressure sensor 14 detects the atmospheric pressure PA, a vehicle speed sensor 15 detects a running speed (vehicle speed) VP of the vehicle driven by the engine 1, and a gear position sensor 16 detects a gear position GP of a transmission of the vehicle. The detection signals of the sensors 14, 15 and 16 are supplied to the ECU 5.

The ECU 5 includes an input circuit, a central processing unit (hereinafter referred to as CPU), a memory circuit, and an output circuit. The input circuit performs numerous functions, including: shaping the waveforms of input signals from the various sensors; correcting the voltage levels of the input signals to a predetermined level; and converting analog signal values into digital signal values. The memory circuit preliminarily stores various operating programs to be executed by the CPU and stores the results of computations, or the like, by the CPU. The output circuit supplies drive signals to the fuel injection valves 6. The ECU 5 controls the valve opening period of each fuel injection valve 6, the ignition timing, and the opening of the EGR valve 22 according to the detection signals from the various sensors. The ECU 5 further operates the intake and exhaust side solenoid valves 35*i* and 35*e* to perform switching control between the all-cylinder operation and the partial-cylinder operation of the engine 1.

The CPU in ECU5 calculates fuel injection periods TCYL and TCYLB of the fuel injection valve 6 which opens in synchronism with the TDC pulse, using the below-described equations (1) and (2), based on the output signals of the above-described sensors. The fuel injection period TCYL is a fuel injection period corresponding to the cylinders (cylinders #1, #2 and #3 on the right bank) whose operation is halted according to the engine operating condition. The fuel injection period TCYLB2 is a fuel injection period corresponding to the cylinders (cylinders #4, #5 and #6 on the left bank) which are always operated during engine operation. Therefore, TCYL is equal to "0" during the partial-cylinder operation. Further, in the all-cylinder operation, TCYL is normally equal to TCYLB2. However, in a transient state, immediately after the end (restart of fuel supply) of the fuel cut operation in which fuel supply to the engine 1 is interrupted, and another transient state, immediately after a transition from the partial-cylinder operation to the all-cylinder operation, the fuel injection periods TCYL and TCYLB take different values. The above-described transient states are hereinafter referred to as the fuel supply restart transient state. Since the amount of fuel injected from the fuel injection valve 6 is substantially proportional to the fuel injection period, TCYL and TCYLB2 are also referred to as fuel injection amounts.

$$TCYL=TIM\times KCMD\times KAF\times KTVLV\times K1+K2 \quad (1)$$

$$TCYLB2=TIM\times KCMD\times KAF\times KTVLVB2\times K1+K2 \quad (2)$$

TIM is a basic fuel amount, i.e., a basic fuel injection period of the fuel injection valve 6, and is determined by retrieving a TI map (not shown) set according to the engine rotational speed NE and the absolute intake pressure PBA.

KTVLV and KTVLVB2 are first and second exhaust valve temperature correction coefficients which are set according to a cooling degree of exhaust valves (not shown) of the engine 1. Each of the correction coefficients KTVLV and KTVLVB 2 is usually set to 1.0, and is set to a value greater than 1.0 in the fuel supply restart transient state described above. Accordingly, in the fuel supply restart transient state, the fuel injection amount is corrected in an increasing direction.

KCMD is a target air-fuel ratio coefficient which is set according to engine operating parameters such as the engine rotational speed NE, the throttle valve opening THA, and the engine coolant temperature TW. The target air-fuel ratio coefficient KCMD is proportional to the reciprocal of an air-fuel ratio A/F (i.e., proportional to a fuel-air ratio F/A) and takes a value of 1.0 for the stoichiometric ratio. Therefore, KCMD is also referred to as a target equivalent ratio.

KAF is an air-fuel ratio correction coefficient calculated so that a detected equivalent ratio KACT, calculated from detected values from the LAF sensor 12, becomes equal to the target equivalent ratio KCMD.

K1 and K2 are, respectively, a correction coefficient and a correction variable computed according to various engine parameter signals. The correction coefficient K1 and correction variable K2 are set to predetermined values that optimize various characteristics such as fuel consumption characteristics and engine acceleration characteristics according to engine operating conditions.

Figure 3:
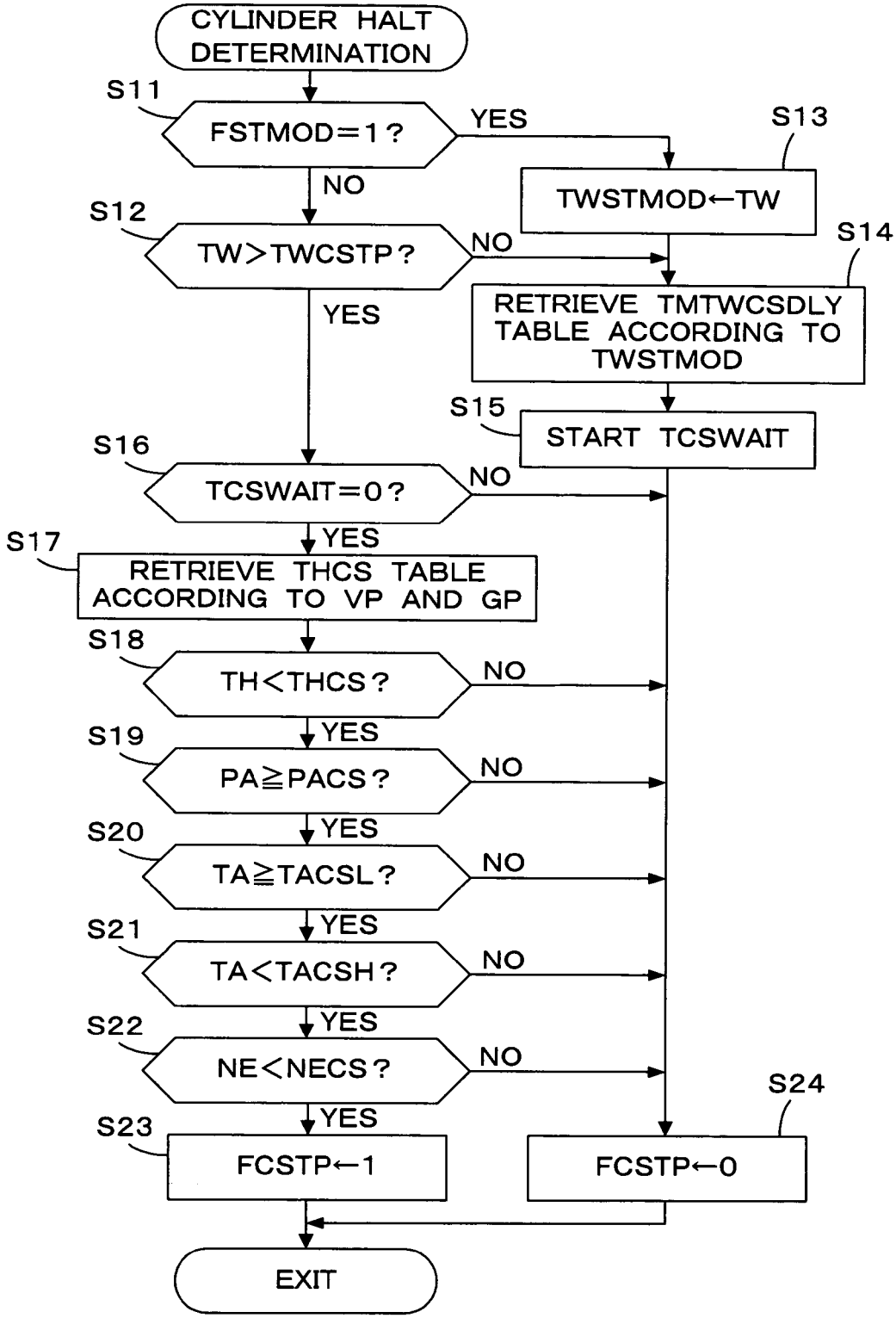
FIG. 3 is a flowchart illustrating a process for determining a cylinder halt condition according to an embodiment of the present invention.

FIG. 3 is a flowchart of a process of determining an execution condition of the cylinder halt (partial-cylinder operation) in which some of the cylinders are halted. The process is executed at predetermined intervals (for example, 10 milliseconds) by the CPU in the ECU 5.

Figure 4:
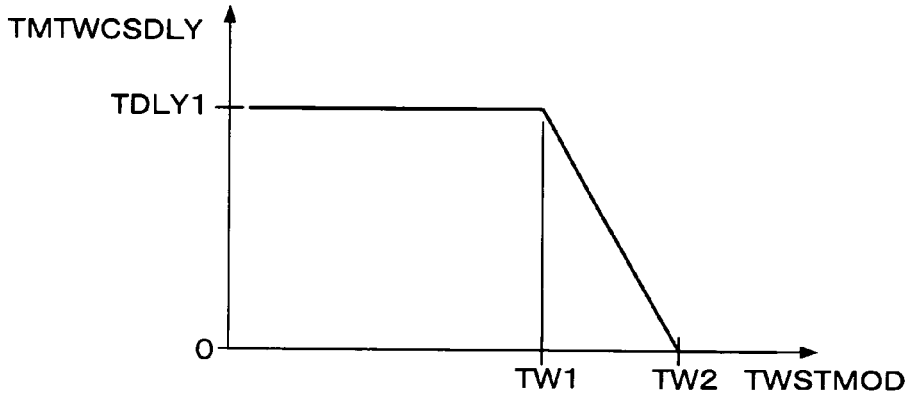
FIG. 4 is a graph showing a delay timetable used in the process of FIG. 3.

In step S11, it is determined whether a start mode flag FSTMOD is 1. If FSTMOD is equal to 1, which indicates that the engine 1 is starting (cranking), then the detected engine water temperature TW is stored as a start mode water temperature TWSTMOD (step S13). Next, a TMTWCSDLY table shown in FIG. 4 is retrieved according to the start mode water temperature TWSTMOD to calculate a delay time TMTWCSDLY. In the TMTWCSDLY table, the delay time TMTWCSDLY is set to a predetermined delay time TDLY1 (for example, 250 seconds) in the range where the start mode water temperature TWSTMOD is lower than a first predetermined water temperature TW1 (for example, 40° C.). The delay time TMTWCSDLY is set so as to decrease as the start mode water temperature TWSTMOD rises in the range where the start mode water temperature TWSTMOD is is equal to or higher than the first predetermined water temperature TW1 and lower than a second predetermined water temperature TW2 (for example, 60° C.). Further, the delay time TMTWCSDLY is set to 0 in the range where the start mode water temperature TWSTMOD is higher than the second predetermined water temperature TW2.

In next step S15, a downcount timer TCSWAIT is set to the delay time TMTWCSDLY and started, and a cylinder halt flag FCSTP is set to 0 (step S24) which indicates the execution condition of the cylinder halt is not satisfied.

If FSTMOD is equal to 0 in step S11, i.e., the engine 1 is operating in the ordinary operation mode, then it is determined whether the engine water temperature TW is higher than a cylinder halt determination temperature TWCSTP (for example, 75° C.) (step S12). If TW is less than or equal to TWCSTP, then it is determined that the execution condition is not satisfied and the process advances to step S14. When the engine water temperature TW is higher than the cylinder halt determination temperature TWCSTP, the process advances from step S12 to step S16 in which it is determined whether a value of the timer TCSWAIT started in step S15 is 0. When TCSWAIT is greater than 0, the process advances to step S24. When TCSWAIT becomes 0, then the process advances to step S17.

Figure 5:
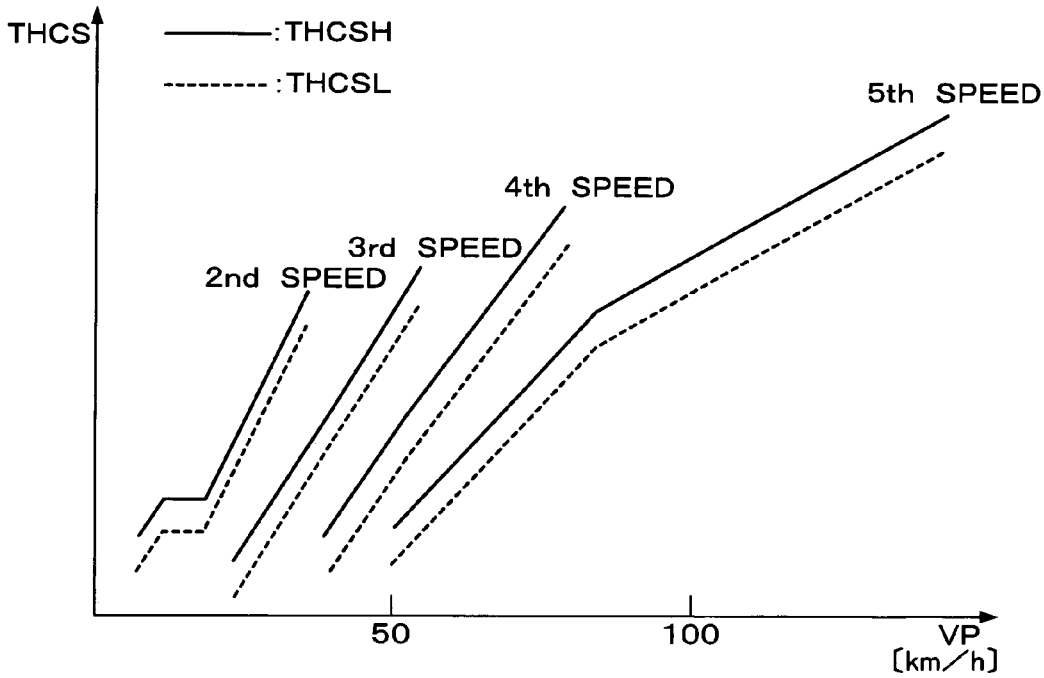
FIG. 5 is a graph showing a threshold value table used in the process of FIG. 3.

In step S17, a THCS table (shown in FIG. 5) is retrieved according to the vehicle speed VP and the gear position GP to calculate an upper side threshold value THCSH and a lower side threshold value THCSL which are used in the determination in step S18. In FIG. 5, the solid lines correspond to the upper side threshold value THCSH and the broken lines correspond to the lower side threshold value THCSL. The THCS table is set for each gear position GP such that, at each of the gear positions (from second speed to fifth speed), the upper side threshold value THCSH and the lower side threshold value THCSL may increase as the vehicle speed VP increases. It should be noted that at the gear position of the 2nd speed, there is provided a region where the upper side threshold value THCSH and the lower side threshold value THCSL are maintained at a constant value even if the vehicle speed VP varies. Further, at the gear position of the 1st speed, the upper side threshold value THCSH and the lower side threshold value THCSL are set, for example, to 0, since the all-cylinder operation is always performed. Furthermore, the threshold values (THCSH and THCSL), corresponding to a lower speed side gear position GP, are set to greater values than the threshold values (THCSH and THCSL) corresponding to a higher speed side gear position GP when compared at a certain vehicle speed.

In step S18, a determination of whether the throttle valve opening TH is less than the threshold value THCS is executed with hysteresis. Specifically, when the cylinder halt flag FCYLSTP is 1 and the throttle valve opening TH increases to reach the upper side threshold value THCSH, then the answer to step S18 becomes negative (NO), while, when the cylinder halt flag FCYLSTP is 0 and the throttle valve opening TH decreases to become less than the lower side threshold value THCSL, then the answer to step S18 becomes affirmative (YES).

If the answer to step S18 is affirmative (YES), it is determined whether the atmospheric pressure PA is equal to, or higher than, a predetermined pressure PACS (for example, 86.6 kPa (650 mmHg)) (step S19). If the answer to step S19 is affirmative (YES), then it is determined whether the intake air temperature TA is equal to, or higher than, a predetermined lower limit temperature TACSL (for example, −10° C.) (step S20). If the answer to step S20 is affirmative (YES), then it is determined whether the intake air temperature TA is lower than a predetermined upper limit temperature TACSH (for example, 45° C.) (step S21). If the answer to step S21 is affirmative (YES), then it is determined whether the engine speed NE is lower than a predetermined speed NECS (step S22). The determination of step S22 is executed with hysteresis similarly as in step S18. Specifically, when the cylinder halt flag FCYLSTP is 1 and the engine speed NE increases to reach an upper side speed NECSH (for example, 3,500 rpm), then the answer to step S22 becomes negative (NO), while, when the cylinder halt flag FCYLSTP is 0 and the engine speed NE decreases to become lower than a lower side speed NECSL (for example, 3,300 rpm), then the answer to step S22 becomes affirmative (YES).

When the answer to any of steps S18 to S22 is negative (NO), it is determined that the execution condition of the cylinder halt is not satisfied and the process advances to step S24. On the other hand, if all of the answers to steps S18 to S22 are affirmative (YES), it is determined that the execution condition of the cylinder halt is satisfied and the cylinder halt flag FCSTP is set to 1 (step S23).

When the cylinder halt flag FCYLSTP is set to 1, the partial-cylinder operation, wherein cylinders #1 to #3 are halted while cylinders #4 to #6 are operated, is performed. When the cylinder halt flag FCYLSTP is set to 0, the all-cylinder operation, wherein all of the cylinders #1 to #6 are operated, is performed.

Next, a relationship between the temperature (cooling degree) of the exhaust valve in the fuel supply restart transient state and the air-fuel ratio will be described below with reference to FIG. 6–FIG. 8.

Figure 6:
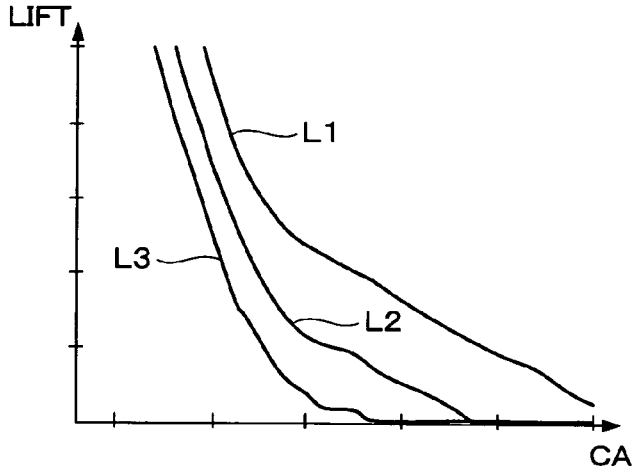
FIG. 6 is a graph for illustrating changes in the lift curve of the exhaust valve according to an embodiment of the present invention.

FIG. 6 shows a lift curve (relationship between a crank angle CA and a lift amount LIFT of the exhaust valve) immediately before the exhaust valve closes. Line L1 shows a lift curve in the normal operating condition, line L2 shows a lift curve after an approximately 30-second stop in operation, and line L3 shows a lift curve after an approximately 10-minute stop in operation. As apparent from FIG. 6, there is a tendency wherein the lift amount LIFT decreases, as the temperature of the exhaust valve decreases.

Figure 7:
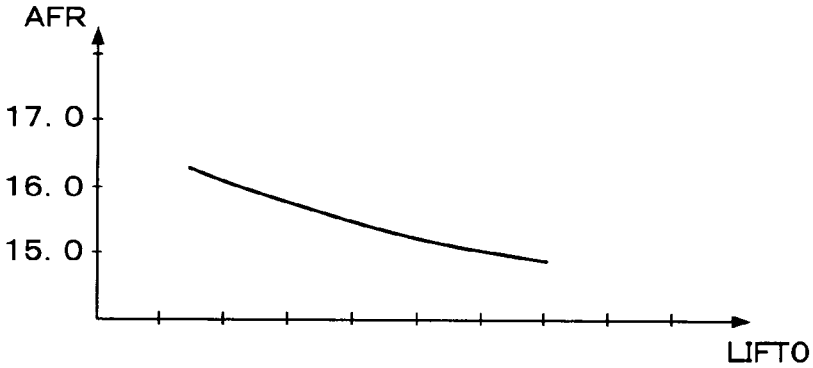
FIG. 7 is a graph showing a relationship between the lift amount of the exhaust valve and the air-fuel ratio according to an embodiment of the present invention.

FIG. 7 shows a relationship between the amount lift LIFT0 of the exhaust valve at a crank angle CA of 10° after the TDC and the air-fuel ratio AFR immediately after restart of fuel supply. As apparent from FIG. 7, the air-fuel ratio tends to shift to a leaner side as the lift amount LIFT0 decreases. The reason for such a tendency is that as the lift amount LIFT0 decreases, an amount of exhaust gases, which return from the exhaust pipe 13 to the combustion chamber, decreases (an internal exhaust gas recirculation amount decreases) which makes the air-fuel ratio AFR shift to the leaner side.

Figure 8:
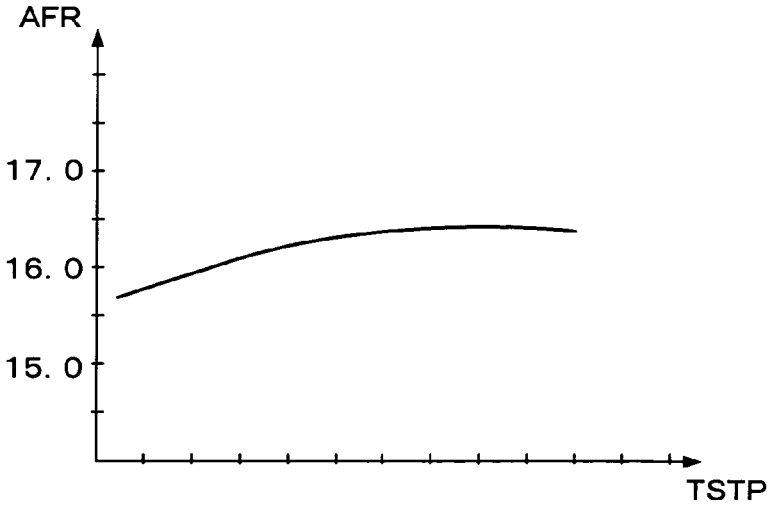
FIG. 8 is a graph showing a relationship between the cylinder stop time period and the air-fuel ratio according to an embodiment of the present invention.

FIG. 8 shows a relationship between a stop time period TSTP of the cylinder and the air-fuel ratio AFR immediately after operation start of the halted cylinder (immediately after restart of fuel supply). As apparent from FIG. 8, the air-fuel ratio AFR tends to shift to a leaner side as the stop time period TSTP becomes longer, i.e., as the cooling degree of the exhaust valve becomes greater.

Therefore, in the fuel supply restart transient state, the air-fuel ratio deviation can be suppressed by correcting the fuel supply amount in an increasing direction and increasing the correction amount as the cooling degree of the exhaust valve becomes greater.

Figure 9:
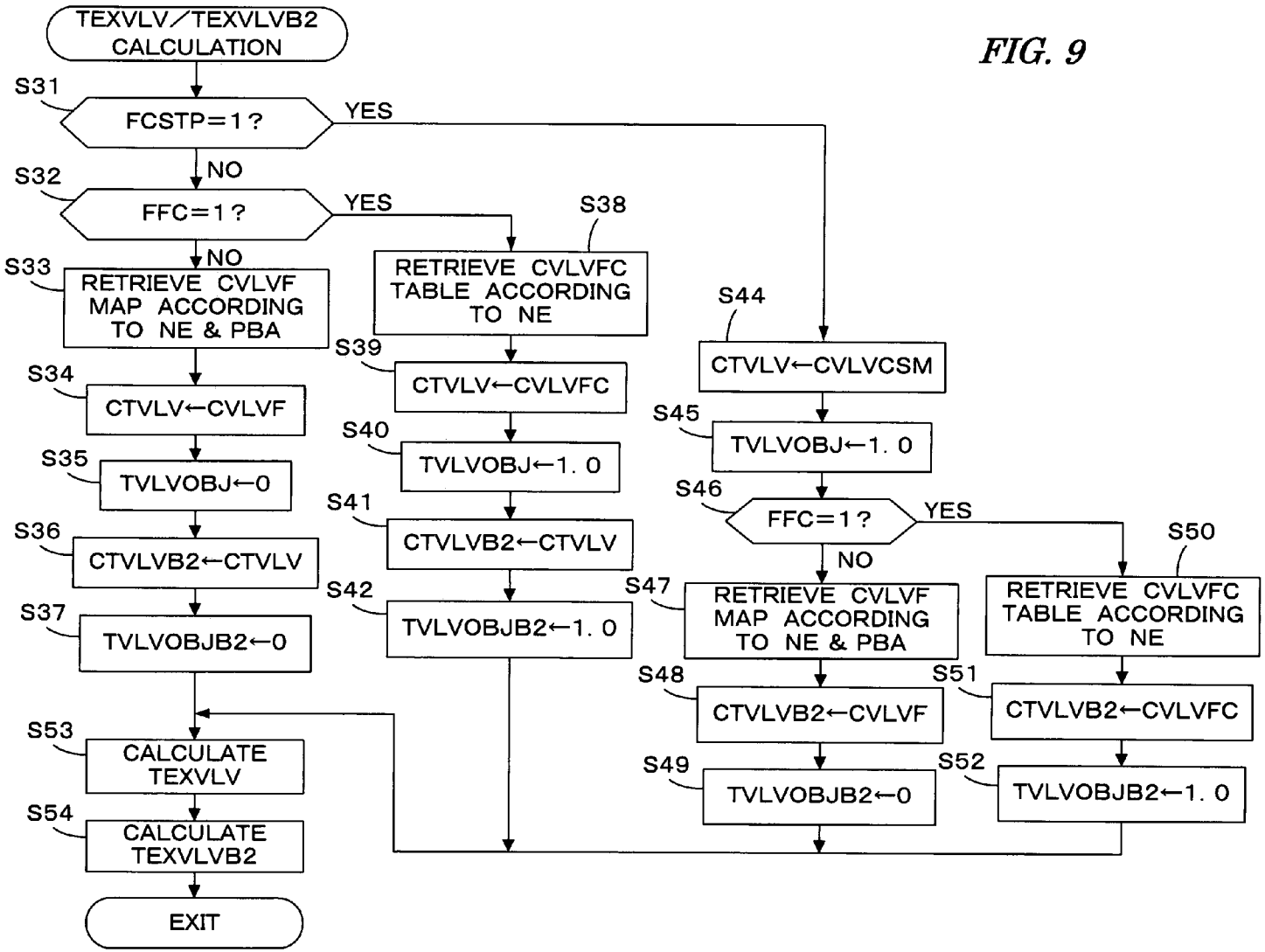
FIG. 9 is a flowchart of a process for calculating parameters indicative of the cooling degree of the exhaust valve according to an embodiment of the present invention.

FIG. 9 is a flowchart of a process used for calculating a first cooling degree parameter TEXVLV and a second cooling degree parameter TEXVLVB2, both of which are indicative of the cooling degree of the exhaust valve. The process is executed at predetermined time intervals (for example, 100 milliseconds) by the CPU in the ECU5. The first cooling degree parameter TEXVLV corresponds to the exhaust valves of the cylinders (#1–#3) on the right bank, and the second cooling degree parameter TEXVLVB2 corresponds to the exhaust valves of the cylinders (#4–#6) on the left bank.

In step S31, it is determined whether the cylinder halt flag FCSTP is 1. If FCSTP is equal to 0, i.e., during the all-cylinder operation, it is determined whether a fuel cut flag FFC is 1 (step S32). The fuel cut flag FFC is set to 1 when it is determined, in a process which is not shown, that the engine 1 is operating in the operating condition where fuel supply to the engine 1 can be stopped.

If FFC is equal to 0, indicating that the normal operation is being performed, a CVLVF map (not shown) is retrieved according to the engine rotational speed NE and the absolute intake pressure PBA to calculate a normal operation coefficient value CVLVF (step S33). The CVLVF map is set so that the normal operation coefficient value CVLVF increases as the engine rotational speed NE increases or the absolute intake pressure PBA increases. In step S34, a first averaging coefficient CTVLV, corresponding to the cylinders on the right bank, is set to the normal operation coefficient value CVLVF calculated in step S33. The first averaging coefficient CTVLV is an averaging coefficient which is used in the calculation of step S53 and is set to a value between 0 and 1.

In step S35, a first cooling degree target value TVLVOBJ, corresponding to the cylinders on the right bank, is set to 0. In step S36, a second averaging coefficient CTVLVB2, corresponding to the cylinders on the left bank, is set to the same value as the first averaging coefficient CTVLV. In step S37, a second cooling degree target value TVLVOBJB2, corresponding to the cylinders on the left bank, is set to 0. The second averaging coefficient CTVLVB2 is an averaging coefficient which is used in the calculation of step S54 and is set to a value between 0 and 1.

In step S53, the first cooling degree target value TVLVOBJ and the first averaging coefficient CTVLV are applied to the below-described equation (3) to calculate the first cooling degree parameter TEXVLV corresponding to the cylinders on the right bank, wherein $$TEXVLV = CTVLV \times TVLVOBJ + (1 - CTVLV) \times TEXVLV \quad (3)$$

where TEXVLV on the right side is a preceding calculated value.

In step S54, the second cooling degree target value TVLVOBJB2 and the second averaging coefficient CTVLVB2 are applied to the below-described equation (4) to calculate the second cooling degree parameter TEXVLVB2 corresponding to the cylinders on the left bank, wherein $$TEXVLVB2 = CTVLVB2 \times TVLVOBJB2 + (1 - CTVLVB2) \times TEXVLVB2 \quad (4)$$

where TEXVLVB2 on the right side is a preceding calculated value.

Figure 10:
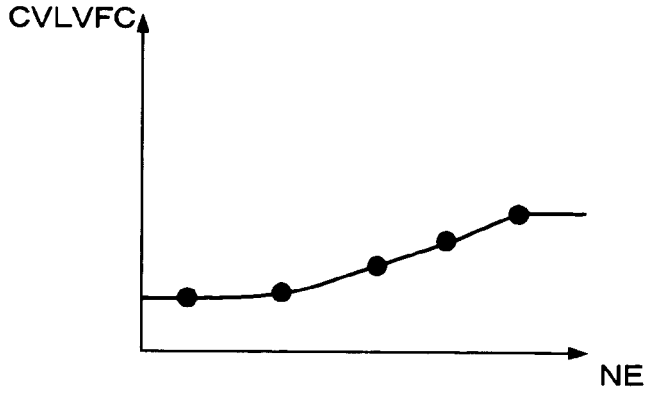
FIG. 10 shows a table used in the process of FIG. 9.

If FFC is equal to 1 in step S32, indicating that the fuel cut operation is being performed, a CVLVFC table shown in FIG. 10 is retrieved according to the engine rotational speed NE to calculate a fuel cut coefficient value CVLVFC (step S38). The CVLVFC table is set so that the fuel cut coefficient value CVLVFC increases as the engine rotational speed NE increases. In step S39, the first averaging coefficient CTVLV is set to the fuel cut coefficient value CVLVFC calculated in step S38.

In step S40, the first cooling degree target value TVLVOBJ is set to 1.0. In step S41, the second averaging coefficient CTVLVB2 is set to the same value as the first averaging coefficient CTVLV. In step S42, the second cooling degree target value TVLVOBJB2 is set to 1.0. Thereafter, the process proceeds to step S53.

If FCSTP is equal to 1 in step S31, i.e., during the partial-cylinder operation, the first averaging coefficient CTVLV is set to a predetermined halt cylinder coefficient value CVLVCSM (for example, 0.001). In step S45, the first cooling degree target value TVLVOBJ is set to 1.0.

In step S46, it is determined whether the fuel cut flag FFC is 1. If FFC is equal to 0, indicating that fuel is supplied to the operating cylinders, the CVLVF map is retrieved according to the engine rotational speed NE and the absolute intake pressure PBA to calculate the normal operation coefficient value CVLVF (step S47), like steps S33 and S34, and the second averaging coefficient CTVLVB2 is set to the normal operation coefficient value CVLVF (step S48). In step S49, the second cooling degree target value TVLVOBJB2 is set to 0. Thereafter, the process proceeds to step S53.

If FFC is equal to 1 in step S46, indicating that fuel supply to the operating cylinders is interrupted, the CVLVFC table shown in FIG. 10 is retrieved according to the engine rotational speed NE to calculate the fuel cut coefficient value CVLVFC (step S50), like step S38, and the second averaging coefficient CTVLVB2 is set to the fuel cut coefficient value CVLVFC calculated in step S50 (step S51). In step S52, the second cooling degree target value TVLVOBJB2 is set to 1.0. Thereafter, the process proceeds to step S53.

According to the process of FIG. 9, the first and second cooling degree target values TVLVOBJ and TVLVOBJB2 are set to 0 or 1.0 according to whether the partial-cylinder operation is being performed and whether the fuel cut operation is being performed. Further, the first and second cooling degree parameters TEXVLV and TEXVLVB2 are calculated by averaging the first and second cooling degree target values TVLVOBJ and TVLVOBJB2. That is, the first cooling degree parameter TEXVLV becomes closer to 1.0 as the execution time period of the partial-cylinder operation or the fuel cut operation during the all-cylinder operation becomes longer, while the first cooling degree parameter TEXVLV becomes closer to 0 as the execution time period of the all-cylinder operation (except for the fuel cut operation) becomes longer. Further, the second cooling degree parameter TEXVLVB2 becomes closer to 1.0 as the execution time period of the fuel cut operation becomes longer, while the second cooling degree parameter TEXVLVB2 becomes closer to 0 as the execution time period of the normal operation, in which fuel is supplied to the operating cylinders, becomes longer. Therefore, the first and second cooling degree parameters TEXVLV and TEXVLVB2 can be used as a parameter indicative of the cooling degree of the exhaust valve (a parameter that increases as the temperature of the exhaust valve decreases). The cooling degree of the exhaust valve becomes large in the cylinders which are not operated during the partial-cylinder operation or in the operating cylinders to which fuel supply is interrupted. Accordingly, by taking these factors into consideration, accurate estimation of the cooling degree is performed using a comparatively simple calculation.

Further, by setting the averaging coefficients CTVLV and CTVLVB2 according to the engine rotational speed NE and the absolute intake pressure PBA, or the engine rotational speed NE only, the cooling degree parameters TEXVLV and TEXVLVB2, corresponding to the exhaust flow rate which has a large influence on the cooling degree of the exhaust valve, are calculated. Therefore, the cooling degree is accurately estimated.

Figure 11:
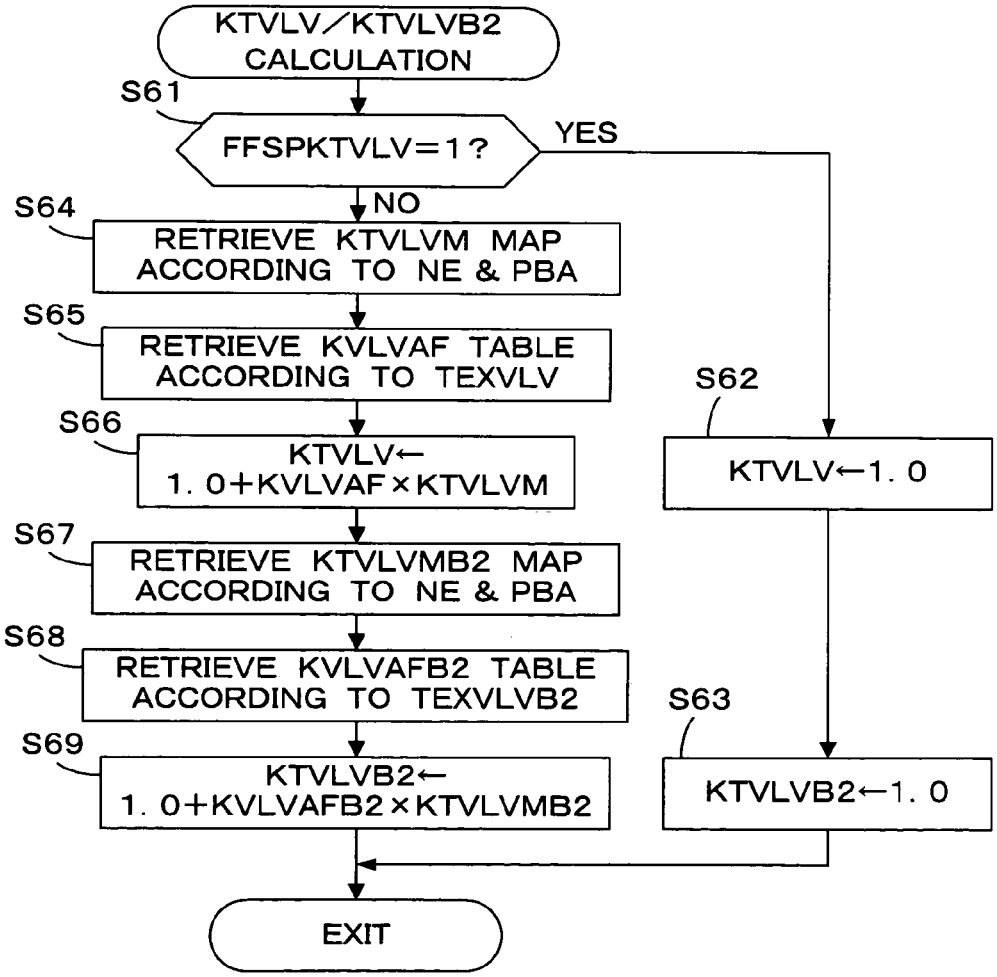
FIG. 11 is a flowchart of a process for calculating correction coefficients of the fuel supply amount according to an embodiment of the present invention.

FIG. 11 is a flowchart of a process used for calculating the first exhaust valve temperature correction coefficient KTVLV and the second exhaust valve temperature correction coefficient KTVLVB2 according to the first cooling degree parameter TEXVLV and the second cooling degree parameter TEXVLVB2 calculated in the process of FIG. 9. The process is executed by the CPU in the ECU5 in synchronism with generation of the TDC pulse.

In step S61, it is determined whether a failure detection flag FFSPKTVLV is 1. The failure detection flag FFSPKTVLV is set to 1 when a failure, which disables correctly estimating the exhaust valve temperature, for example, a failure of the absolute intake pressure sensor 7, is detected.

If FFSPKTVLV is equal to 1, indicating that failure has been detected, the first exhaust valve temperature correction coefficient KTVLV and the second exhaust valve temperature correction coefficient KTVLVB2 are set to 1.0 (steps S62, S63).

If FFSPKTVLV is equal to 0, indicating that failure is not detected, a KTVLVM map (not shown) is retrieved according to the engine rotational speed NE and the absolute intake pressure PBA to calculate a first complete cooling correction amount KTVLVM (step S64). The KTVLVM map is set so that the amount KTVLVM of the first complete cooling correction increases as the engine rotational speed NE becomes high and/or the absolute intake pressure PBA becomes high. The first complete cooling correction amount KTVLVM is a correction amount corresponding to a complete cooling state of the exhaust valve for correcting an amount of fuel supplied to each cylinder on the right bank. The complete cooling state is defined as a state wherein the temperature of the exhaust valve becomes equal to, or less than, 300° C., and the lift amount of the exhaust valve barely changes, even if the temperature decreases further.

Figure 12:
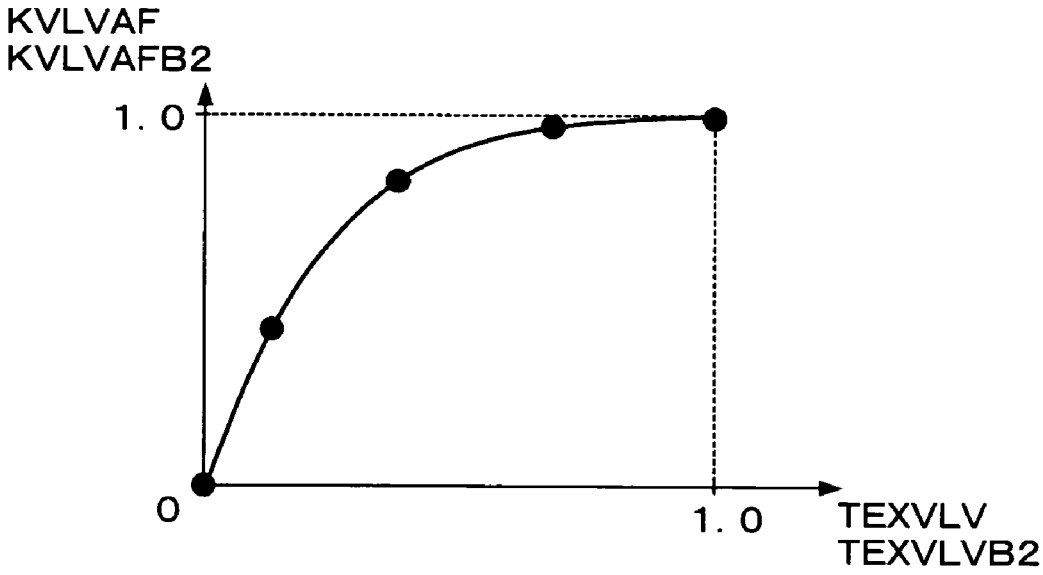
FIG. 12 shows a table used in the process of FIG. 11.

In step S65, a KVLVAF table (shown in FIG. 12) is retrieved according to the first cooling degree parameter TEXVLV to calculate a first cooling degree correction coefficient KVLVAF corresponding to the right bank. The KVLVAF table is set so that the first cooling degree correction coefficient KVLVAF increases as the first cooling degree parameter TEXVLV increases (the exhaust valve temperature decreases).

In step S66, the first complete cooling correction amount KTVLVM and the first cooling degree correction coefficient KVLVAF are applied to the below-described equation (5) to calculate the first exhaust valve temperature correction coefficient KTVLV.

$$KTVLV=1.0+KVLVAF\times KTVLVM \quad (5)$$

In step S67, a KTVLVMB2 map (not shown) is retrieved according to the engine rotational speed NE and the absolute intake pressure PBA to calculate a second complete cooling correction amount KTVLVMB2. The KTVLVMB2 map is set so that the second complete cooling correction amount KTVLVMB2 increases as the engine rotational speed NE becomes high and/or the absolute intake pressure PBA becomes high. The second complete cooling correction amount KTVLVMB2 is a correction amount corresponding to the complete cooling state of the exhaust valve for correcting an amount of fuel supplied to each cylinder on the left bank.

In step S68, a KVLVAFB2 table (shown in FIG. 12) is retrieved according to the second cooling degree parameter TEXVLVB2 to calculate a second cooling degree correction coefficient KVLVAFB2. The KVLVAFB2 table is the same as the KVLVAF table.

In step S69, the second complete cooling correction amount KTVLVMB2 and the second cooling degree correction coefficient KVLVAFB2 are applied to the below-described equation (6) to calculate the second exhaust valve temperature correction coefficient KTVLVB2.

$$KTVLVB2=1.0+KVLVAFB2\times KTVLVMB2 \quad (6)$$

By applying the first exhaust valve temperature correction coefficient KTVLV calculated as described above to the equation (1) and applying the second exhaust valve temperature correction coefficient KTVLVB2 to the equation (2), the fuel amount, which should be increased in the fuel supply restart transient state, is properly controlled according to the cooling degree of exhaust valves to thereby suppress the air-fuel ratio deviation.

In this embodiment, the cylinder halting mechanism 30 corresponds to a switching means; the crank angle position sensor 10 corresponds to a rotational speed detection means; the absolute intake pressure sensor 7 corresponds to an intake pressure detection means; and the crank angle position sensor 10, the absolute intake pressure sensor 7, the intake air temperature sensor 8, the engine water temperature sensor 9, the throttle valve opening sensor 4, and the LAF sensor 12 define an operating condition detection means. Further, the ECU 5 is the fuel supply amount control means, the exhaust valve cooling estimation means, the correction means, the complete cooling correction amount calculation means, the cooling degree correction coefficient calculation means, and the fuel supply interruption means. Specifically, the process (not shown) executed by the CPU in the ECU5 for performing calculations of the equations (1) and (2) corresponds to the fuel supply amount control means and a part of the correction means. The process of FIG. 9 corresponds to the exhaust valve cooling estimation means. The process of FIG. 11 corresponds to another part of the correction means. Furthermore, steps S64 and S67 of FIG. 11 correspond to the complete cooling correction amount calculation means, and steps S65 and S68 of FIG. 11 correspond to the cooling degree correction coefficient calculation means. Further, the process (not shown) which stops (interrupts) fuel supply to the operating cylinders of the engine 1 corresponds to the fuel supply interruption means.

Second Embodiment

In the first embodiment, the normal operation coefficient value CVLVF is calculated according to the engine rotational speed NE and the absolute intake pressure PBA, and the fuel cut coefficient value CVLVFC is calculated according to the engine rotational speed. In another embodiment of the present invention, the normal operation coefficient value CVLVF and the fuel cut coefficient value CVLVFC are calculated according to an intake air flow rate Gair (an intake air amount per unit time period) of the engine 1. The another embodiment is the same as the first embodiment except for the points described below.

In the another embodiment, an intake air flow rate sensor (not shown) for detecting the intake air flow rate Gair of the engine 1 is disposed in the intake pipe 2 of the engine 1, and the detection signal is supplied to the ECU5.

Figure 13:
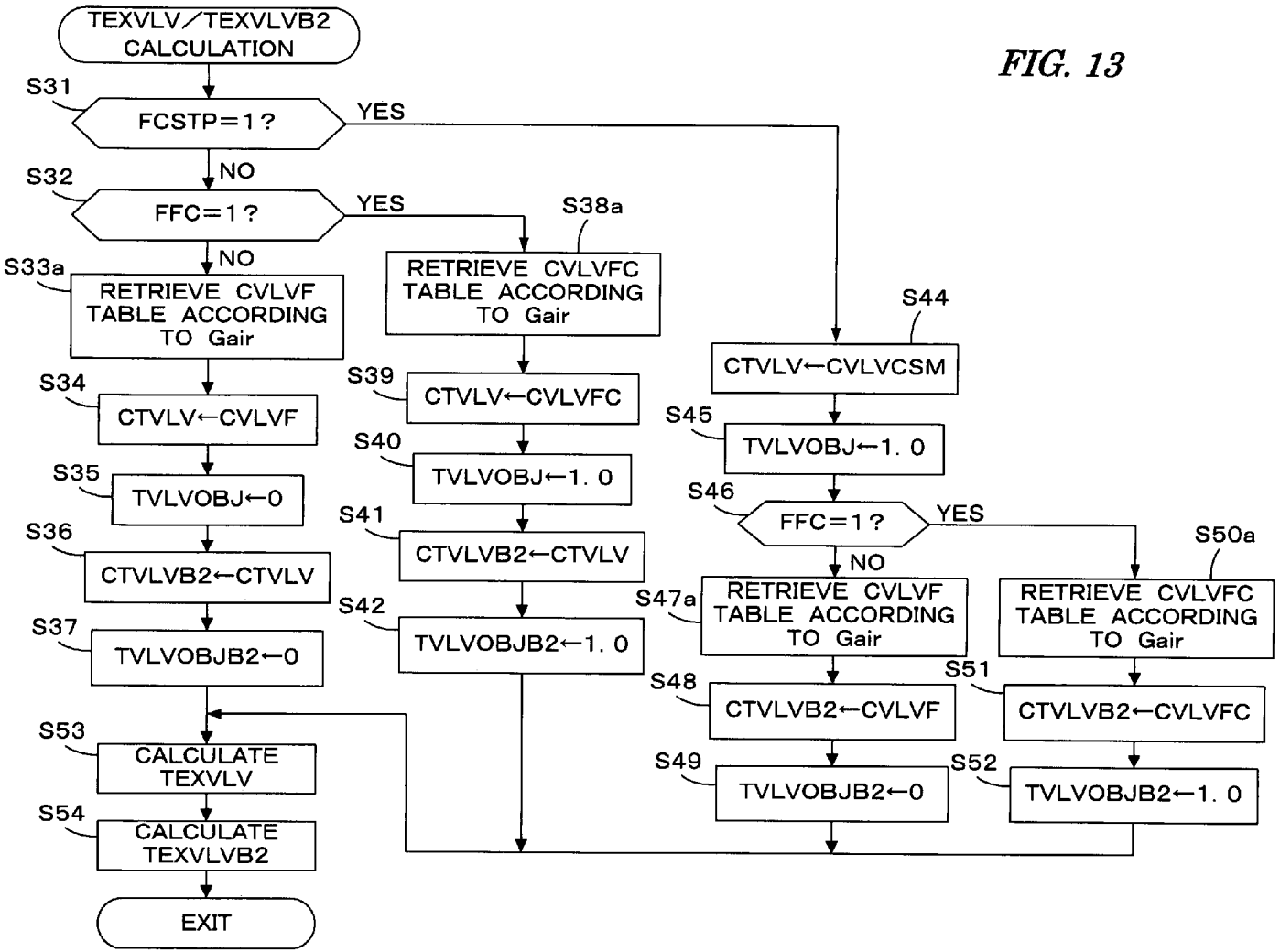
FIG. 13 is a flowchart of the process used for calculating parameters indicative of the cooling degree of the exhaust valve according to another embodiment of the present invention.

FIG. 13 is a flowchart of the process for calculating the first cooling degree parameter TEXVLV and the second cooling degree parameter TEXVLVB2. The process of FIG. 13 is obtained by replacing steps S33, S38, S47, and S50 of FIG. 9, respectively, with steps S33*a*, 38*a*, 47*a*, and 50*a*.

Figure 14A:
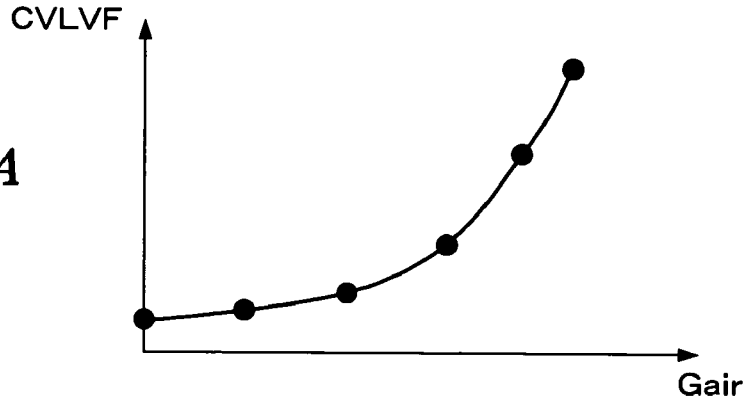
FIGS. 14A and 14B, respectively, show a table used in the process of FIG. 13.
Figure 14B:
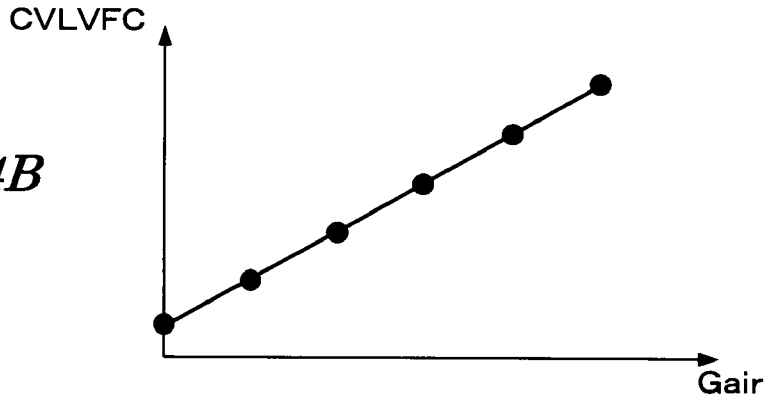

In steps S33*a* and S47*a*, the normal operation coefficient value CVLVF is calculated by retrieving a CVLVF table shown in FIG. 14(*a*) according to the intake air flow rate Gair. The CVLVF table is set so that the normal operation coefficient value CVLVF increases and an increasing rate of the normal operation coefficient value CVLVF (an inclination of the curve) increases as the intake air flow rate Gair increases.

Further, in steps S38*a* and S50*a*, the fuel cut coefficient value CVLVFC is calculated by retrieving a CVLVFC table shown in FIG. 14(*b*) according to the intake air flow rate Gair. The CVLVFC table is set so that the fuel cut coefficient value CVLVFC substantially increases in proportion to an increase in the intake air flow rate Gair.

Figure 15:
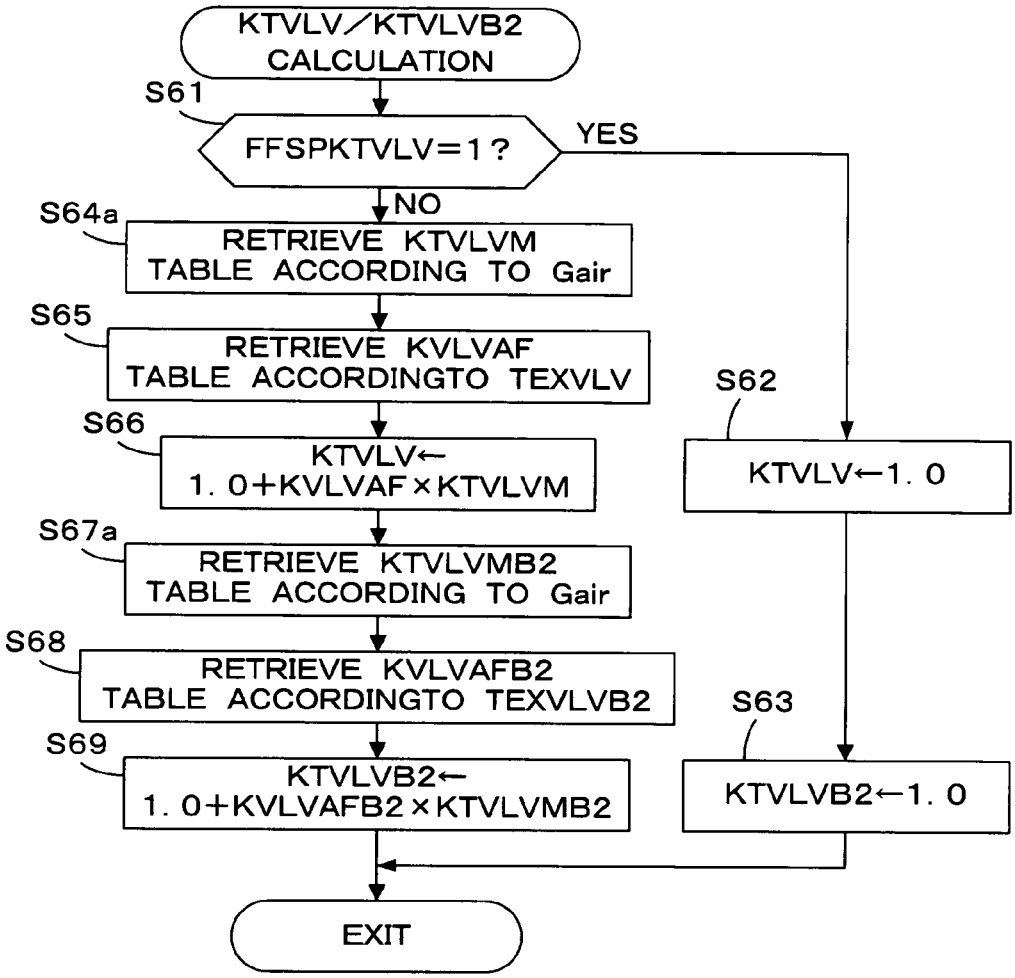
FIG. 15 is a flowchart of the process for calculating correction coefficients of the fuel supply amount according to the another embodiment of the present invention.

FIG. 15 is a flowchart of the process for calculating the first exhaust valve temperature correction coefficient KTVLV and the second exhaust valve temperature correction coefficient KTVLVB2. The process of FIG. 15 is obtained by replacing steps S64 and S67 of FIG. 11, respectively, with steps S64*a* and S67*a*.

Figure 16:
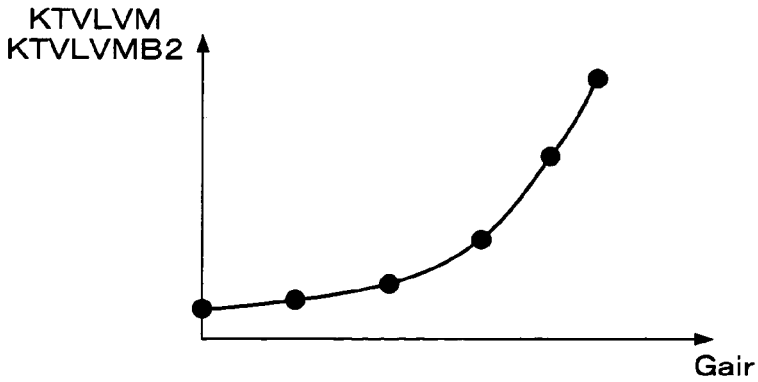
FIG. 16 shows a table used in the process of FIG. 15.

In step S64*a*, the first complete cooling correction amount KTVLVM is calculated by retrieving a KTVLVM table shown in FIG. 16 according to the intake air flow rate Gair. The KTVLVM table is set so that the first complete cooling correction amount KTVLVM increases and a rate (inclination) of increase in the amount KTVLVM increases, as the intake air flow rate Gair increases.

In step S67*a*, the second complete cooling correction amount KTVLVMB2 is calculated by retrieving a KTVLVMB2 table shown in FIG. 16 according to the intake air flow rate Gair. The KTVLVMB2 table is the same as the KTVLVM table.

The averaging coefficients CTVLV and CTVLVB2 are set according to the intake air flow rate Gair. Accordingly, the cooling degree parameters TEXVLV and TEXVLVB2, corresponding to the exhaust flow rate which has a large influence on the cooling degree of the exhaust valve, are calculated, which makes it possible to estimate the cooling degree of the exhaust valve with high accuracy.

The process of FIG. 13 corresponds to the exhaust valve cooling estimation means, and the process of FIG. 15 corresponds to a part of the correction means. Further, steps S64*a* and S67*a* of FIG. 15 correspond to the complete cooling correction amount calculation means, and steps S65 and S68 of FIG. 15 correspond to the cooling degree correction coefficient calculation means.

The present invention is not limited to the embodiments described above, and it is within the scope of the present invention to make various modifications thereto. For example, in the above-described embodiment, the cylinder halting mechanism 30 halts three cylinders of the six-cylinder engine. Alternatively, the cylinder halting mechanism 30 is configured so that it may halt one or two cylinders of six cylinders. Further, the present invention can be applied to an engine having a plurality of cylinders, such as a four-cylinder engine or an eight-cylinder engine.

Further, in the above-described embodiments, the present invention is used to control the fuel supply of an engine having the cylinder halting mechanism 30. Alternatively, the present invention is applicable to control the fuel supply of an engine not having a cylinder halting mechanism.

Further, in steps S33, S43, and S47 of FIG. 9, the averaging coefficient values are calculated according to the engine rotational speed NE and the absolute intake pressure PBA. Alternatively, the averaging coefficient value may be calculated according to either one of the engine rotational speed NE and the absolute intake pressure PBA.

Furthermore, the present invention can be used to control a fuel supply for a watercraft propulsion engine, such as an outboard engine having a vertically extending crankshaft.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

What is claimed is:

1. A fuel supply control system for an internal combustion engine, comprising:

operating condition detection means for detecting an operating condition of said engine;

fuel supply amount control means for controlling an amount of fuel to be supplied to said engine according to the detected operating condition of said engine;

exhaust valve cooling estimation means for estimating a cooling degree of at least one exhaust valve of said engine; and correction means for correcting the amount of fuel to be supplied to said engine by increasing the amount of fuel to be supplied thereto based on the cooling degree estimated by said exhaust valve cooling estimation means, wherein said fuel supply amount control means supplies the amount of fuel corrected by said correction means to said engine.

2. The fuel supply control system according to claim 1, wherein said operating condition detection means includes rotational speed detection means for detecting a rotational speed of said engine, and intake pressure detection means for detecting an intake pressure of said engine, and wherein said exhaust valve cooling estimation means estimates the cooling degree according to at least one of the detected engine rotational speed and the detected intake pressure.

3. The fuel supply control system according to claim 1, wherein said operating condition detection means includes intake air flow rate detection means for detecting an intake air flow rate of said engine, and said exhaust valve cooling estimation means estimates the cooling degree according to the detected intake air flow rate.

4. The fuel supply control system according to claim 1, wherein said correction means includes complete cooling correction amount calculation means for calculating a complete cooling correction amount according to the detected engine operating condition, and cooling degree correction coefficient calculation means for calculating a cooling degree correction coefficient according to the cooling degree, the complete cooling correction amount being a correction amount corresponding to a complete cooling state of said at least one exhaust valve, and wherein said correction means corrects the fuel amount using the complete cooling correction amount and the cooling degree correction coefficient.

5. The fuel supply control system according to claim 1, wherein said engine has a plurality of cylinders and switching means for switching between a partial-cylinder operation wherein at least one of said plurality of cylinders is halted, and an all-cylinder operation wherein all of said cylinders are operated, wherein said fuel supply amount control means has fuel supply interrupting means for interrupting fuel supply to at least one operating cylinder according to the detected engine operating condition, and wherein said exhaust valve cooling estimation means estimates the cooling degree according to whether the all-cylinder operation or the partial-cylinder operation is being performed, and whether the fuel supply interruption is being performed.

6. The fuel supply control system according to claim 1, wherein said correction means performs the correction to increase the fuel supply amount as the estimated cooling degree increases.

7. A fuel supply control method for an internal combustion engine, comprising the steps of:

a) detecting an operating condition of said engine;

b) calculating an amount of fuel to be supplied to said engine according to the detected operating condition of said engine;

c) estimating a cooling degree of at least one exhaust valve of said engine;

d) correcting the calculated fuel amount based on the estimated cooling degree by increasing the fuel amount, and e) controlling the fuel amount supplied to said engine according to the corrected fuel amount.

8. The fuel supply control method according to claim 7, wherein said step a) of detecting the operating condition of said engine includes a step of detecting a rotational speed of said engine, and a step of detecting an intake pressure of said engine, wherein the cooling degree is estimated according to at least one of the detected engine rotational speed and the detected intake pressure.

9. The fuel supply control method according to claim 7, wherein said step a) of detecting the operating condition of said engine includes a step of detecting an intake air flow rate of said engine, wherein the cooling degree is estimated according to the detected intake air flow rate.

10. The fuel supply control method according to claim 7, wherein said step d) of correcting the fuel amount includes a step of calculating a complete cooling correction amount according to the detected engine operating condition, and a step of calculating a cooling degree correction coefficient according to the cooling degree, wherein the complete cooling correction amount is a correction amount corresponding to a complete cooling state of said at least one exhaust valve, and wherein the fuel amount is corrected using the complete cooling correction amount and the cooling degree correction coefficient.

11. The fuel supply control method according to claim 7, wherein said engine has a plurality of cylinders and a switching mechanism for switching between a partial-cylinder operation wherein at least one of said plurality of cylinders is halted, and an all-cylinder operation wherein all of said cylinders are operated, and said step e) of controlling the fuel supply amount includes a step of interrupting fuel supply to at least one operating cylinder according to the detected engine operating condition, and wherein the cooling degree is estimated according to whether the all-cylinder operation or the partial-cylinder operation is being performed, and whether the fuel supply interruption is being performed.

12. The fuel supply control method according to claim 7, wherein said correction is performed to increase the fuel supply amount as the estimated cooling degree increases.

13. A computer program embodied on a computer-readable medium, for causing a computer to carry out a fuel supply control method for an internal combustion engine, said fuel supply control method comprising the steps of:

a) detecting an operating condition of said engine;

b) calculating an amount of fuel to be supplied to said engine according to the detected operating condition of said engine;

c) estimating a cooling degree of at least one exhaust valve of said engine;

d) correcting the calculated fuel amount based on the estimated cooling degree by increasing the fuel amount, and e) controlling the fuel amount supplied to said engine according to the corrected fuel amount.

14. The computer program according to claim 13, wherein said step a) of detecting the operating condition of said engine includes a step of detecting a rotational speed of said engine, and a step of detecting an intake pressure of said engine, wherein the cooling degree is estimated according to at least one of the detected engine rotational speed and the detected intake pressure.

15. The computer program according to claim 13, wherein said step a) of detecting the operating condition of said engine includes a step of detecting an intake air flow rate of said engine, wherein the cooling degree is estimated according to the detected intake air flow rate.

16. The computer program according to claim 13, wherein said step d) of correcting the fuel amount includes a step of calculating a complete cooling correction amount according to the detected engine operating condition, and a step of calculating a cooling degree correction coefficient according to the cooling degree, wherein the complete cooling correction amount is a correction amount corresponding to a complete cooling state of said at least one exhaust valve, and wherein the fuel amount is corrected using the complete cooling correction amount and the cooling degree correction coefficient.

17. The computer program according to claim 13, wherein said engine has a plurality of cylinders and a switching mechanism for switching between a partial-cylinder operation wherein at least one of said plurality of cylinders is halted, and an all-cylinder operation wherein all of said cylinders are operated, and said step e) of controlling the fuel supply amount includes a step of interrupting fuel supply to at least one operating cylinder according to the detected engine operating condition, and wherein the cooling degree is estimated according to whether the all-cylinder operation or the partial-cylinder operation is being performed, and whether the fuel supply interruption is being performed.

18. The computer program according to claim 13, wherein said correction is performed to increase the fuel supply amount as the estimated cooling degree increases.

* * * * *